United States Patent [19]

Roberts

[11] 4,175,472

[45] Nov. 27, 1979

[54] ROTARY HYDRAULIC MACHINE

[75] Inventor: Thomas E. E. Roberts, Birmingham, England

[73] Assignee: Lucas Industries Limited, Birmingham, England

[21] Appl. No.: 858,944

[22] Filed: Dec. 9, 1977

[30] Foreign Application Priority Data

Jan. 27, 1977 [GB] United Kingdom ..... 3284/77

[51] Int. Cl.[2] ..... F01B 13/04

[52] U.S. Cl. ..... 91/6.5; 91/499

[58] Field of Search ..... 91/499, 505, 6.5

[56] References Cited

U.S. PATENT DOCUMENTS 3,208,397 9/1965 Lohrer et al. ..... 91/505

FOREIGN PATENT DOCUMENTS 2308805 11/1976 France ..... 91/499

1268203 3/1972 United Kingdom ..... 91/499

1321476 6/1973 United Kingdom ..... 91/499

*Primary Examiner*—William L. Freeh

[57] ABSTRACT

A rotary hydraulic pump or motor has a piston-carrying rotor having a face engaging a port plate which includes a high pressure port. A valve arrangement is responsive to the pressures in the high pressure port and in successive ones of the rotor bores to provide that variation in these pressures causes variation of the position, relative to top-dead-center, at which successive rotor bores communicate with the high pressure port through by-pass passages, and thereby substantially equalize the pressures in the bores and the high pressure port. The port plate and rotor also include passages by which the pressures in the rotor bores can be increased rapidly after their respective top-dead-center positions.

4 Claims, 5 Drawing Figures

ROTARY HYDRAULIC MACHINE

This invention relates to rotary hydraulic machines of the type in which rotation of a piston-carrying rotor accompanies displacement of a liquid through the machine.

It is known in machines of the foregoing type, to provide a port plate which is provided with a port and which as a surface engaged by a face of rotor, the rotor has bores through which displaced liquid flows, and rotation of the rotor causes these bores to be successively brought into communication with the port in the port plate.

At the instant of first communication between a bore and the port a rapid change of pressure, accompanied by a shock wave, can occur within the bore and in delivery or inlet passages of the machine, unless the pressures in the bore and the port are substantially equal at the instant of communication. It is known to attempt to overcome this problem by providing suitable precompression or decompression of the liquid within the bores, prior to these bores being brought into communication with the port. U.S. Pat. No. 4,048,903 discloses an arrangement in which a valve is responsive to variations in the pressures in the rotor bores and in a port in the port plate, to ensure that these bores and the port are interconnected at times when the pressures therein are equal, whereby variations in an external pressure load or in rotor bore pressure, are automatically compensated for.

If the machine is to work at high pressures, it has in the past been proposed to increase the pre-compression angle, that is the angle through which the rotor travels to move each cylinder bore from top-dead-centre into a position in which that cylinder bore communicates with the stator port, whereby the pressure at the instant of interconnection is increased. However, such an increase in the precompression angle necessarily results in a greater change in the volume swept by each piston between top-dead-centre and the afore-mentioned position of intercommunication, this volume change being known as the volume step. The increased volume step has been found to result in an increase in the shock waves generated in the machine, so that at high operating pressures the improvements obtained as a result of a pressure-responsive interconnecting valve are largely negated.

It is an object of the present invention to provide a rotary hydraulic machine of the foregoing type in which increased operating pressures are not accompanied by undue increase in the magnitude of shock waves within the machine.

According to the invention a rotary hydraulic machine comprises a rotor having a plurality of bores which open on to a face of the rotor, piston means, responsive to rotation of the rotor, for causing liquid displacement within said bores to accompany said rotation, a port plate against one face of which said rotor face is engaged, said port plate including a first port with which said bores can successively communicate, valve means, between said first port and said port plate face and responsive to the pressures in said first port and in said bores for varying the precompression angle at which a liquid within said bores can first flow to said first port, and means for admitting a quantity of said liquid at a high pressure into said bores before said bores can first communicate with said first port through said valve means.

In a preferred embodiment said means for admitting liquid to said bores comprises a plurality of passages in said rotor communicating with respective ones of said bores and having openings on to said rotor face, and a first passage in said port plate, opening on to said port plate face at a location which lies on the path thereover of said rotor passage openings, said high pressure liquid being applied, in use, to said first passage.

In a further preferred embodiment said valve means comprises a second passage in said port plate communicating with said first port and with port means which open on to said port plate face, said port means being spaced from said first port, in a direction of the path of movement of said bores across said face, so that said bores communicate, in use, with said port means before communicating with said first port, said port means extending in said direction of movement, and a control element, responsive to an increase in pressures in said bores for progressively uncovering said port means in a direction away from said first port, and to an increase in pressure in said first port for progressively covering said port means in a direction towards, said first port.

An embodiment of the invention will now be described by way of example only and with reference to the accompanying drawings in which.

Figure 1:
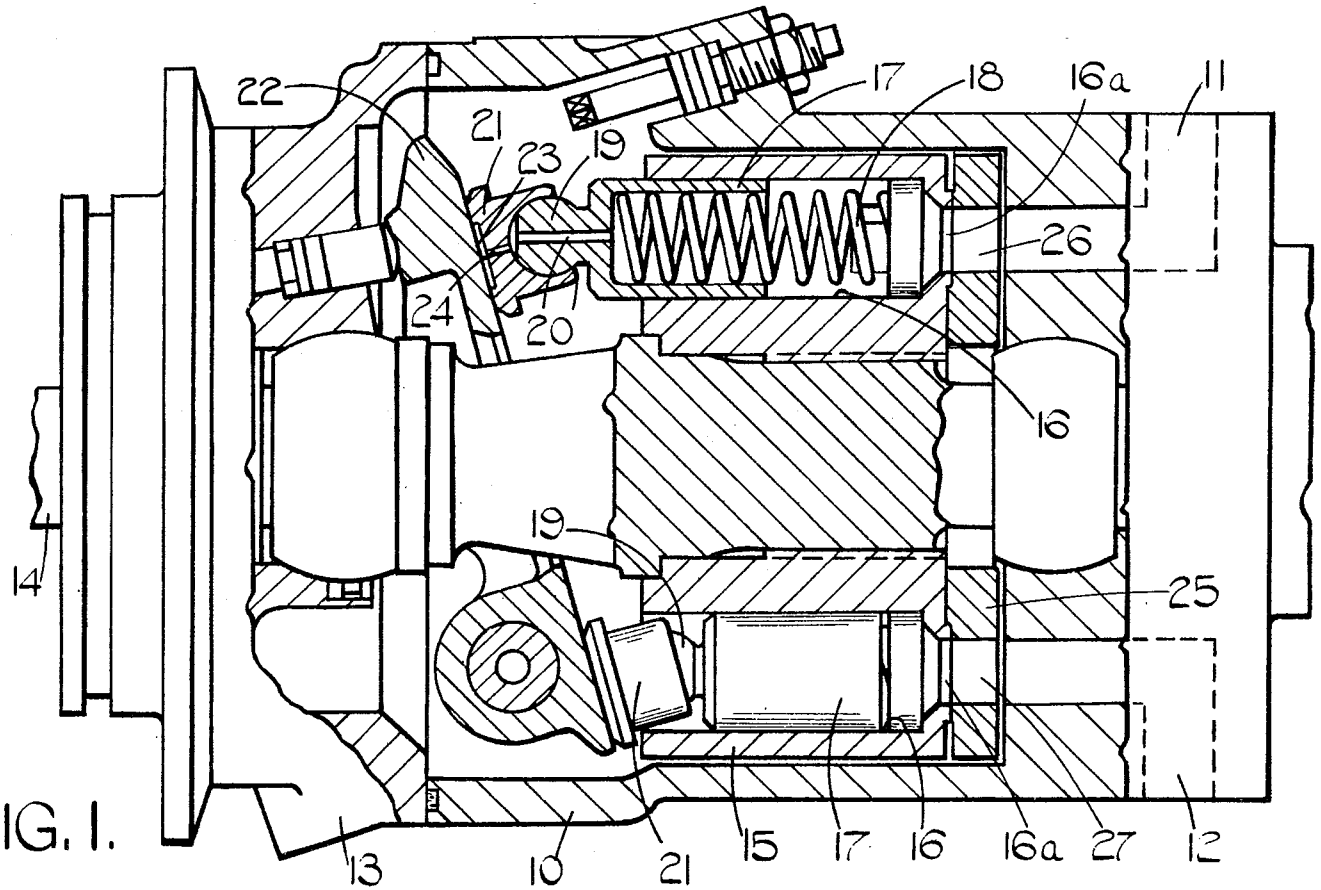
FIG. 1 is a section through an axial-piston pump.

The pump is of the swash plate type and comprises a housing 10 having an outlet 11 and an inlet 12 at one end. The other end of the housing 10 is closed by a cover 13 in which is journalled a shaft 14. Connected to the shaft 14 and within the housing 10 is a rotor 15 in which is a plurality of equi-angularly spaced bores 16, each containing a piston 17 biased by a compression spring 18. The bores 16 terminate in portions **16*a* which open on to one end face of the rotor 15**.

Each piston 17 has a spherical end portion 19 with a flat face at its end remote from the rotor 15. A bore in each portion 19 opens into the bore 16 and onto the flat face of the portion 19. The portions 19 are respectively engaged in complementary sockets in slippers 21. Each slipper has a face formed with a hydrostatic bearing pocket 23 which communicates via a bore 24 in the slipper 21 with the space therein defined by the flat end of the portion 19.

The slippers 21 bear against an inclined swash plate 22 pivotally mounted adjacent the cover 13. As the rotor 15 rotates, the swash plate cause reciprocation of the pistons 19 in their respective bores 16.

The face of the rotor 15 remote from the swash plate engages one face of an annular port plate 25. The plate 25 is formed with two arcuate ports 26, 27 which respectively communicate with the outlet 11 and inlet 12.

Figure 2:
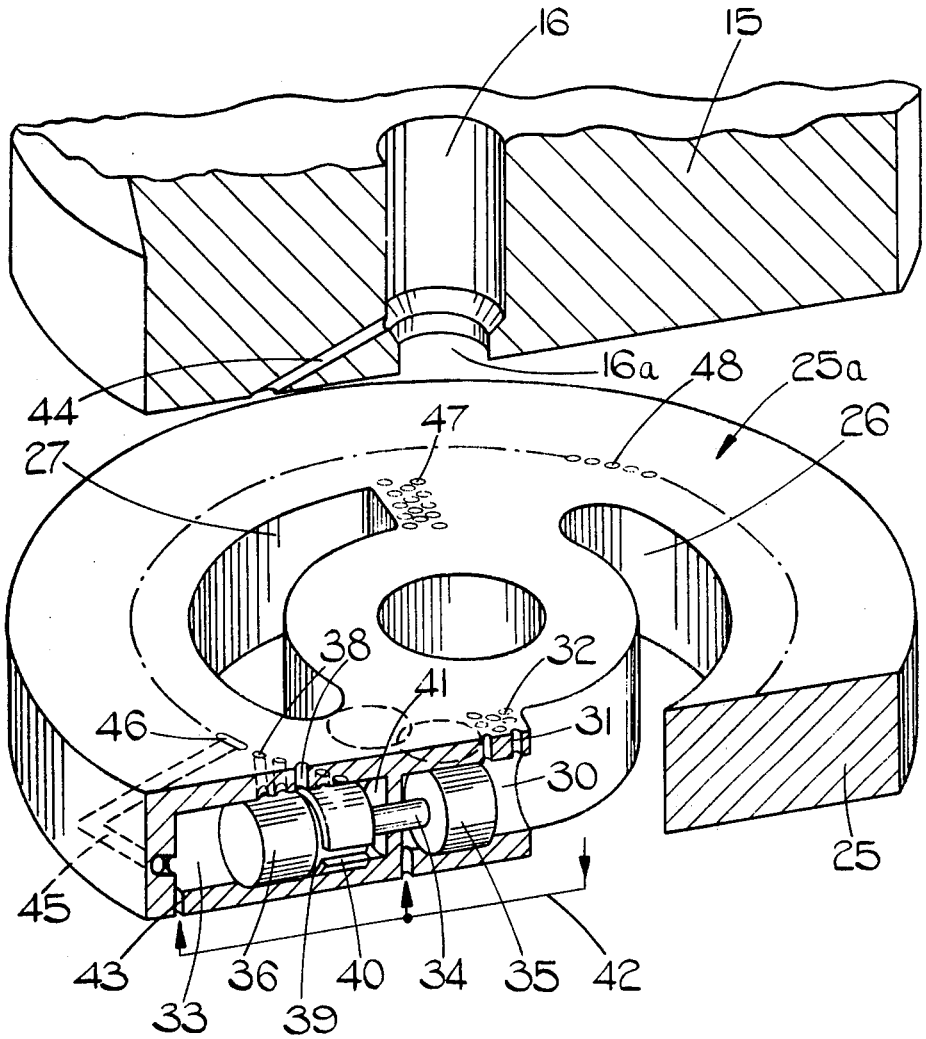
FIG. 2 is a pictorial exploded view of part of the rotor and port plate of the pump.

In the example shown the rotor 15 moves, in use, anti-clockwise as seen in FIG. 2, so that the bore portions **16*a*, one of which is indicated in FIG. 2, sweep across the ports 26, 27** sequentially.

A bore 30 extends within the port plate 25 and communicates with one end of the port 26. A plurality of holes 31 communicate with the bore 30 and open on to the face **25*a* of the port plate 25 which is engaged by the rotor 15. The holes 31 provide a plurality of ports 32 which are spaced from each other and from the adjacent end of the port 26. The ports 32 extend away from the adjacent end of the port 26, in the path of movement of the bore portions 16***a*, so that each of the bore portions 16*a* successively communicates with the ports 32 before communicating with the port 26. The holes 31 and bore 30 thus define a passage through which liquid can flow from the bores 16 to the port 26.

The port plate 25 also includes a cylinder 33 which is axially aligned with the bore 30. A spool control element 34 has a control piston portion 35 and an actuator piston portion 36 respectively slidable in the bore 30 and cylinder 33. A plurality of passages 38 communicate with the cylinder 33 and open on to the face 25*a* of port plate 25 so as to be spaced apart in the path of movement of a point on the face of the rotor 15 over the port plate face 25*a*.

The actuator piston portion 36 has an annular groove 39 which communicates via a passage 40 with a volume 41 which is defined within the cylinder 33 by the piston portion 36. An increase in the pressure within the groove 39 urges element 34 to the left as shown in FIG. 2, so as successively to uncover holes 31. A passage 42 allows the side of the piston portion 35 which is remote from the port 26, and the side of the piston portion 36 which is remote from the volume 41, to be subjected to the pressure within port 26.

The rotor 15 has a plurality of passages 44 which connect respective ones of the bores 16 with the face of the rotor 15 which engages the face 25*a* of the port plate 25. The ends of passages 44 remote from the bores 16 are positioned so as to pass sequentially across the ends of the passages 38 as the rotor 15 rotates.

A passage 45 communicates with the port 26 via a restrictor 43, the cylinder 33 and passage 42 and opens on to the face 25*a* at an elongated port 46 which lies on the path of movement of the ends of the passages 44. The location of the port 46 is such that the passages 44 communicate therewith immediately after the pistons 17 have reached top-dead-centre.

In use, the pump operates in a known manner to draw fluid from the inlet 12 and to discharge it at a higher pressure from the outlet 11. As a piston 17 moves onwards from its top-dead-centre position, a charge of pressurised fluid from the port 26 is applied via the restrictor 43 and passages 45, 44 to the bore 16 associated with that piston. The pressure in the bores 16 can thereby be raised rapidly from that at the inlet port 27 to a value which is a substantial fraction of the pressure in the port 26. Subsequent rotation of the rotor 15 causes precompression of the fluid in each bore 16, towards a value equal to that of the pressure in port 26. Because of the charge admitted to the bores 16, the required precompression angle is small and the volume step change is also correspondingly small.

The spool control element 34 is positioned in accordance with the difference between the pressures in the port 26 and the volume 41, if the element 34 is initially in its most rightward position, as seen in FIg. 2, the holes 31 are shut off by the piston portion 35 and the annular groove 39 in piston portion 36 communicates with the most anti-clockwise one of the passages 38, i.e., that which is nearest to the port 26. If the precompression pressure within a bore 16 is greater than the pressure in port 26, introduction of this precompression pressure to volume 41 urges the element 34 to the left to uncover the one of the holes 31 which is nearest the port 26, this leftward movement is almost instantaneous, and stops when the groove 39 ceases to communicate with the most anti-clockwise of the passages 38 and communicates with the next adjacent passage 38.

The element 34 may in this way be moved to the left in one or more steps until the precompression pressure in the bores 16 is equal to that in port 26. Any subsequent variation of the precompression pressure, or of the pressure in port 26 will cause element 34 to move in steps to a new equilibrium position. It will be understood that these movement steps occur when successive passages 44 communicate, via an appropriate one of the passages 38, with the volume 41. The element 34 will thus move rapidly to its equilibrium position. Since the element 34 is thus responsive to any difference between the precompression pressure and the pressure in the port 26, it will be understood that the dimensions and locations of the ports 32 and passages 38 may readily be arranged so that the precompression pressure is maintained substantially equal to that within the port 26, and that this condition can be maintained during variations in the strokes of the pistons 17 and despite variations in the pressure in port 26.

A further control element (not shown), identical with the element 34, is associated with the port 27, and has associated ports 47 and passages 48 which respectively correspond to the ports 32 and passages 38 previously described. The further control element acts to match the decompression pressures in the bores 16 to the pressure in the inlet port 27.

Figure 3:
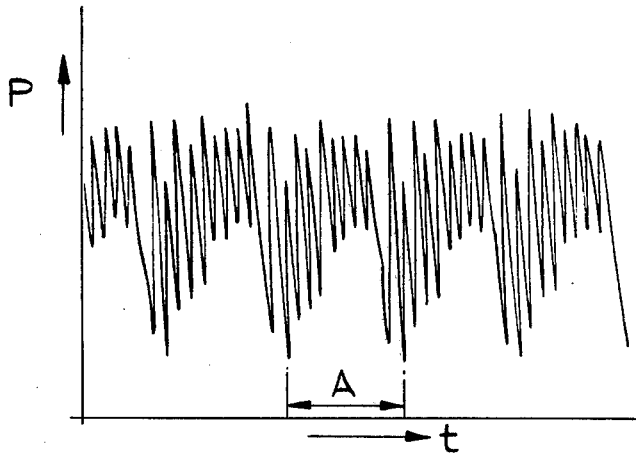
FIGS. 3 and 4, show pressure fluctuations recorded within known pumps.
Figure 4:
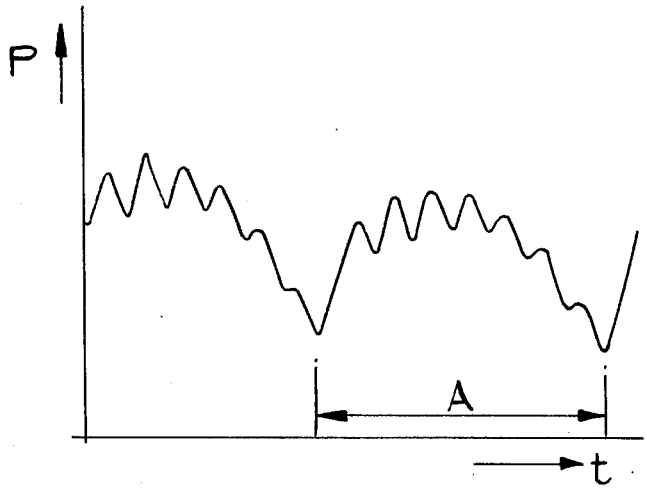
Figure 5:
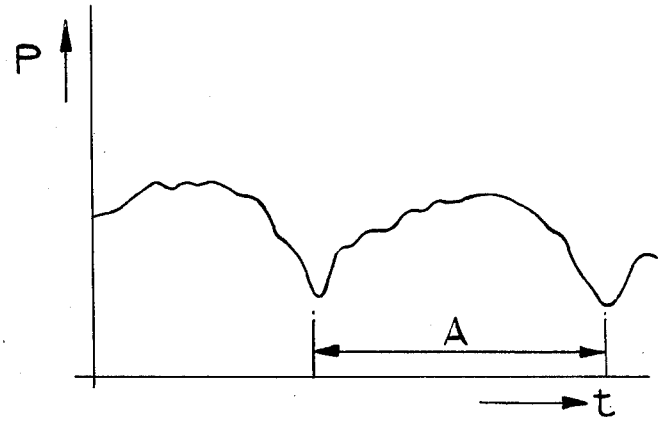
FIG. 5, shows pressure fluctuations recorded within a pump according to the present invention.

FIGS. 3 to 5 show traces of pressure P plotted against time t for a variety of seven-cylinder rotary hydraulic pumps, the pump strokes and external loads being in each case adjusted so that the pump output pressure is 13800 kPa. The vertical scales of all the traces are identical and the time A in each case represents one seventh of a revolution of the rotor.

FIG. 3 is the trace for a pump which is not provided with either a pressure balancing valve control element 34 or with means for introducing a high pressure into the piston bore just after top-dead-centre. The pressure fluctuations, or "ripple" exceeds 2,760 kPa.

FIG. 4, shows the trace for a pump provided with a pressure balancing valve control member 34, but not with means for introducing high pressure just after top-dead-centre. It will be seen that the total pressure fluctuation has been reduced to 1930 kPa, upon which is super-imposed a much reduced ripple.

FIG. 5, shows the trace for a pump according to the invention. The maximum pressure fluctuations have been further reduced to 1175 kPa and ripple has been still further reduced. This large reduction in high frequency ripple greatly reduces the noise produced by the machine and it is anticipated that wear due to frettage and high frequency stress will be correspondingly reduced. It will be understood that the invention is equally applicable to radial piston pumps, where variation in the piston strokes may be accompanied by variations, relative to the port plate of the position at which piston top-dead-centre occurs.

The invention is also applicable to hydraulic motors, the ports 32 and passages 38 being located, as before, adjacent the high pressure ports 26 which in this latter case communicate with the motor inlet.

I claim:

1. A rotary hydraulic machine, comprising a rotor having a plurality of bores which open onto a face of the rotor, piston means responsive to rotation of the rotor, for causing liquid displacement within said bores to accompany said rotation, a port plate against one face of which said rotor face is engaged, said port plate including a first port with which said bores can successively communicate, valve means, between said first port and said port plate face responsive to pressures in said first port and in said bores for varying the precompression angle at which a liquid within the bores can first flow to said first port, said valve means including a second passage in said port plate communicating with said first port and with port means which open onto said port plate face, said port means being spaced from said port, in the direction of the path of movement of said bores across said face, so that said bores communicate, in use, with said port means before communicating with said first port, said port means extending in said direction of movement, and a control element responsive to an increase in pressures in said bores for progressively uncovering said port means in a direction away from said first port, and to an increase in pressure in said port for progressively covering said port means in a direction towards said first port, and means for admitting liquid to said bores including a plurality of passages in said rotor communicating with respective ones of said bores and having openings onto said rotor face, and a first passage in said port plate, opening onto said port plate face in a loction which lies on the path thereover of said rotor passage openings, said high pressure liquid being applied, in use, to said first passage.

2. A machine as claimed in claim 1 in which said first passage communicates with said first port.

3. A machine as claimed in claim 1 in which said control element includes an actuator piston portion having one side responsive to the pressures in said bores and another side responsive to the pressure in said first port.

4. A machine as claimed in claim 3 in which said one side of the actuator piston portion is subjected to the pressure in said first passage.

* * * * *